United States Patent [19]

Mitchell

[11] Patent Number: 4,686,725

[45] Date of Patent: Aug. 18, 1987

[54] MATTRESS CUSHION WITH SECUREMENT FEATURE

[75] Inventor: Charles B. Mitchell, Greenville, S.C.

[73] Assignee: Span America Medical Systems, Greenville, S.C.

[21] Appl. No.: 792,573

[22] Filed: Oct. 28, 1985

[51] Int. Cl.[4] ..... A47C 27/14

[52] U.S. Cl. ..... 5/481; 5/468

[58] Field of Search ..... 5/481, 448, 431, 471, 5/498, 468

[56] References Cited

U.S. PATENT DOCUMENTS

| | | | |
|---|---|---|---|
| 658,789 | 10/1900 | Legg | 5/500 |
| 2,184,808 | 12/1939 | Belian | 5/347 |
| 2,609,548 | 9/1952 | Doane | 5/360 |
| 2,620,494 | 12/1952 | Kay | 5/354 |
| 2,783,827 | 3/1957 | Neely | 155/179 |
| 2,785,739 | 3/1957 | McGregor, Jr. et al. | 155/179 |
| 3,066,321 | 12/1962 | Kintner | 5/498 |
| 3,258,791 | 7/1966 | Kaplan | 5/347 |
| 3,713,697 | 1/1973 | Koepke | 297/456 |
| 3,940,811 | 2/1976 | Tomikawa et al. | 5/361 R |
| 4,110,881 | 9/1978 | Thompson | 29/91.1 |
| 4,265,484 | 5/1981 | Statler | 297/452 |
| 4,276,666 | 7/1981 | Yamada | 5/481 |
| 4,326,310 | 4/1982 | Frakenberg | 5/448 |

FOREIGN PATENT DOCUMENTS

| | | | |
|---|---|---|---|
| 1179789 | 12/1984 | Canada | 5/448 |
| 2025234 | 1/1980 | United Kingdom | 5/448 |

*Primary Examiner*—Carl D. Friedman
*Assistant Examiner*—Naoko N. Slack
*Attorney, Agent, or Firm*—Dority & Manning

[57] ABSTRACT

A mattress supplement comprised of resilient material is substantially covered with support projections except for at least one marginal edge thereof. The marginal edge is adapted to compressively receive a sheet fitted thereto. The compression of the marginal edge permits the sheet to be secured to a mattress on which the mattress supplement is placed, instead of being pushed off thereof by the support projections.

3 Claims, 5 Drawing Figures

MATTRESS CUSHION WITH SECUREMENT FEATURE

BACKGROUND OF THE INVENTION

This invention concerns in general a mattress cushion, and more particularly a cushion (or pad) for use on a mattress with a fitted or flat sheet secured on top thereof. A mattress cushion in accordance with this invention may be comprised of a resilient material having a plurality of projections thereon, but with at least one marginal region thereof free from such projections. This marginal region functions as a live edge for compression so as to resiliently receive sheets supplied thereto.

The prior art has long known pads made of resilient material which are intended to be placed on top of existing mattresses as a supplement thereto. Some such mattress pads undoubtedly are intended to be used as a supplement for a mattress, with a fitted or flat sheet subsequently applied thereto. In general, a conventional fitted sheet is one which has preformed corners, usually having elastic therein, to fit snugly over a mattress. The size of the fitted sheet generally is made to prefit certain known standard sizes of mattresses.

Flat sheets generally are rectangular sheets which have no such fitted corners, but which may be snugly fit to a mattress by conventional folding techniques. With regards to either the flat or fitted sheet, it is intended that the sheets fit snugly on the mattress on which they are placed. Sheets which do not form a snug fit are generally undesirable because of the uncomfortable loose fit which results. Hence, fitted sheets are generally more popular than flat sheets with a large number of people because fitted sheets are preformed to fit specific sizes of mattresses.

Prior art mattress pads generally vary the degree of comfort which they add to a mattress by varying their determined pad thicknesses and densities of material. However, additional comfort in the form of additional thickness is conversely proportional to the ease with which conventional sheets may be fit on top of the pad applied to a particular mattress. In other words, the thicker the pad, the more likely it is to push sheets up away from the mattress, and thereby defeat the intended snug fit thereof.

Some pads present a relatively flat or uni-surface profile to the covering which will be placed above them. Examples of such art include the U. S. Pat. to Thompson (4,110,881), the U.S. Pat. to Stalter (4,265,484) and the Canadian Patent to Paul (1,179,789). Such type of pads may include slots or similar cuts into the body of the pad so as to form individual projections or resiliently responsive portions of the pad. Such cuts maximize pad response to loading placed thereon. This particular group of prior art references includes marginal areas surrounding the slotted individualized resilient sections, but such marginal areas have the same height profile as the individual sections. Therefore, the full thickness of the pads still cause sheets placed thereon to be repelled upward away from the mattress to which they are intended to be secured.

The U.S. Pat. to Neely (2,783,827) discloses a rubber pad for use in upholstered spring construction. The rubber pad has a marginal area which is cut at an angle. The purpose of such an angled marginal area is to be wrapped around the edge of a chair which is being upholstered. Material is secured thereto as illustrated by the figures of Neely. However, the remainder of the rubber pad has no projections thereon, and instead forms a flat surface only. Also, the angled marginal edge once wrapped in its intended place merely provides a convenient flat surface on the side of the upholstered item for securing the covering material thereover with hog rings.

The U.S. Pat. to Legg (658,798) discloses a marginal area which is angled and which surrounds projections of a bed protector. The angled margin is made of solid rubber and intended to serve as an inclined plane surface for slipping the bed protector underneath the occupant of a bed. The solid inner edges of the rubber marginal region surround a plurality of pegs so as to form a moat therearound, for the purpose of retaining any water passed onto the mattress by an occupant. It is not apparent from this patent that there is any intention of placing a sheet between the occupant and the pad since fluids are expected to be passed by the occupant, nor does it appear that the marginal edge made of solid rubber could resiliently receive any such sheet were it to be placed on the bed pad.

U.S. Pat. No. 3,940,811 by Tomikawa, et al. discloses lightweight construction material used as core material for a mattress. Laminations of sheet material are press molded on both sides thereof to form complementary concave and convex patterns. A thin marginal portion of the sheet is not impressed with the concave or convex patterns. However, the resulting element, made of plastic materials such as foamed polyethylene type resin, is only used as an intermediate construction element in the center of a mattress, to be further surrounded by layers of foam on both sides thereof. No final article results which is satisfactory to serve as a supplement between a mattress and conventional sheets applied thereto.

The U.S. Pat. No. 3,258,751 to Kaplan is generally representative of prior art which illustrates a foam pad having a plurality of projections thereon, the pad being applied to a mattress, with a sheet placed on top of the pad and mattress. The general shortcomings of such prior art articles are further discussed below in conjunction with prior art FIG. 3*a* of this application.

In general, numerous other prior art padding articles are known including some made of various foam materials and having various projections, but none of which are concerned with the particular features of the present invention. Examples of such prior art articles include:

| Inventor | U.S. Pat. No. | Issue Date |
|---|---|---|
| Frankenburg | 4,326,310 | Apr. 27, 1982 |
| Koepke | 3,713,697 | Jan. 30, 1973 |
| McGregor, Jr. et al. | 2,785,739 | Mar. 19, 1957 |
| Kay | 2,620,494 | Dec. 9, 1952 |
| Doane | 2,609,548 | Sept. 9, 1952 |
| Belian | 2,184,808 | Dec. 26, 1939 |

SUMMARY OF THE INVENTION

In broad terms, this invention discloses a mattress pad adapted for placement on top of a conventional mattress, with a known flat or fitted sheet to be applied thereto. In general, the pad has a plurality of projections formed thereon, which define a marginal region on the pad for resiliently receiving the sheets applied thereto.

More specifically, this invention concerns a cushion for a mattress having a base member comprising resilient material and at least one straight edge and having a flat bottom surface for placement on a mattress; a plurality of projections integrally formed with the base member on one side thereof opposite the flat bottom surface, with ends of the projections defining a support surface; and at least one marginal region, integral with the base member along at least one straight edge thereof, defining a margin surface parallel with and in between the flat bottom surface and the support surface.

It is an object of this invention to provide a pad for a mattress which maximizes comfort to a user by virtue of the particular thickness and density thereof, while simultaneously assuring the snug securement of a conventional sheet onto the pad and mattress.

It is a further object of this invention to provide generally a mattress pad which greatly enhances the comfort of an existing mattress without interfering with the fit of a conventional sheet onto such mattress.

The foregoing discussion is offered as a brief summary of the present invention. It is not intended to be limiting thereto, but simply to serve as an introduction to the following complete description thereof.

BRIEF DESCRIPTION OF THE DRAWINGS

One of ordinary skill in the art may gain a full and enabling understanding of the present invention by studying the following detailed description thereof, in conjunction with the accompanying figures, in which.

Figure 1:
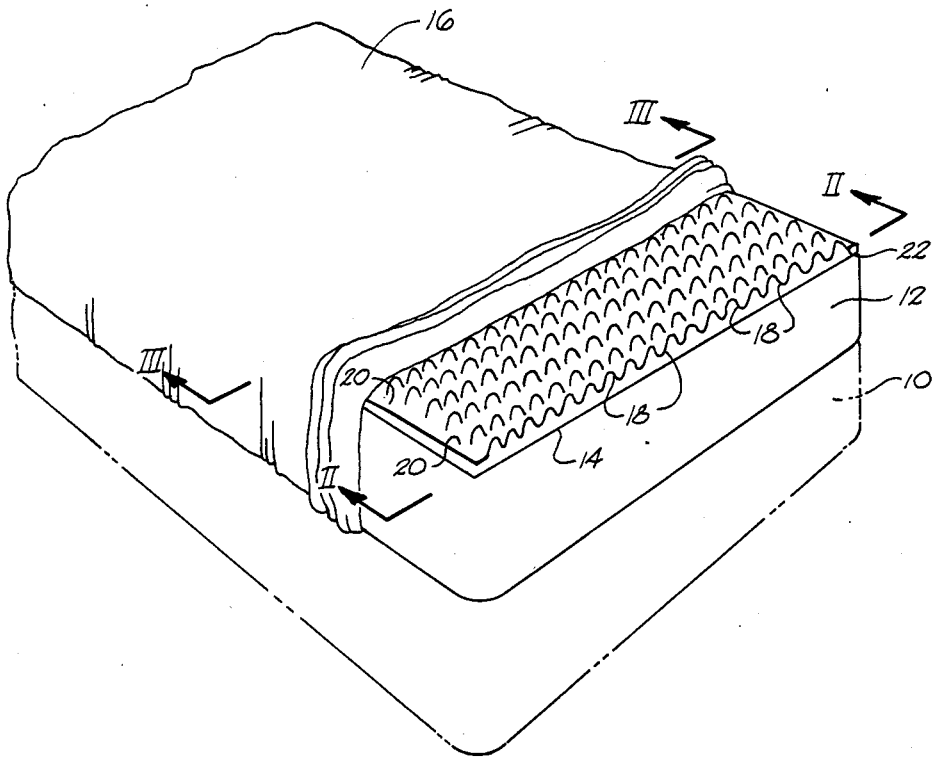
FIG. 1 illustrates a conventional mattress set and a sheet for covering the set, and a mattress pad in accordance with the present invention.

Plural uses of the same reference characters is intended to indicate same or analogous elements. None of the figures of this application are drawn such that the relative indicated sizes should be interpreted as strictly to scale. Specific dimensions are intended only in the instances where explicitly stated.

DETAILED DESCRIPTION OF THE PREFERRED EMBODIMENTS

FIG. 1 illustrates a conventional mattress set being used with the present invention. A lower mattress 10 generally comprises some form of box springs, while an upper mattress 12 is usually referred to as simply "mattress." Use of the term mattress hereinafter is intended to refer to an upper mattress unit such as 12. Mattress 12 and box springs unit 10 usually are manufactured or selected so as to be used in paired units. Conventional sizes of mattress 12 and springs 10 are known by the terms standard (or twin), full, queen and king.

The mattress pad 14 of this invention may be of any size in relation to a given mattress 12, but typically has the same rectangular dimensions as the conventional size mattress with which it is intended to be used. For larger-sized conventional mattress, such as king-sized mattresses, mattress pad 14 may be split into two or more units, as further illustrated and discussed in FIG. 2, below, for convenience in packaging, shipping and/or manufacturing.

Referring again to FIG. 1, a mattress pad 14 is illustrated in place on top of a mattress 12, which in turn rests on box springs 10. Sheet 16 which is placed on top of mattress pad 14 illustrates a conventional sheet, in this instance a fitted sheet, which may be ordinarily applied to mattress 12. In FIG. 1, sheet 16 is mostly in place over both mattress 12 and mattress pad 14, but is partially pulled back to more clearly illustrate the relationship of mattress pad 14 with its supporting mattress 12. Of course, sheet 16 may also alternatively be a conventional flat sheet, as discussed above.

A plurality of projections 18 are formed on mattress pad 14, as well as flat marginal regions 20 and 22 along certain edge portions thereof. These features are more clearly illustrated in the cross-section of FIGS. 2, 3 and 3*b*. The mattress pad 14 may itself be comprised of various resilient materials, but in the preferred embodiment comprises 100% virgin polyurethane foam to provide a consistent quality of touch and feel to the user. Various densities of material may be used, but a density of approximately 1.6 pounds per cubic foot is preferred. Likewise, all materials which are functionally equivalent to polyurethane foam are included within the scope of this invention. An overall thickness of approximately two inches is also preferred, but a range of thicknesses may be suitable for practice of the invention.

Figure 2:
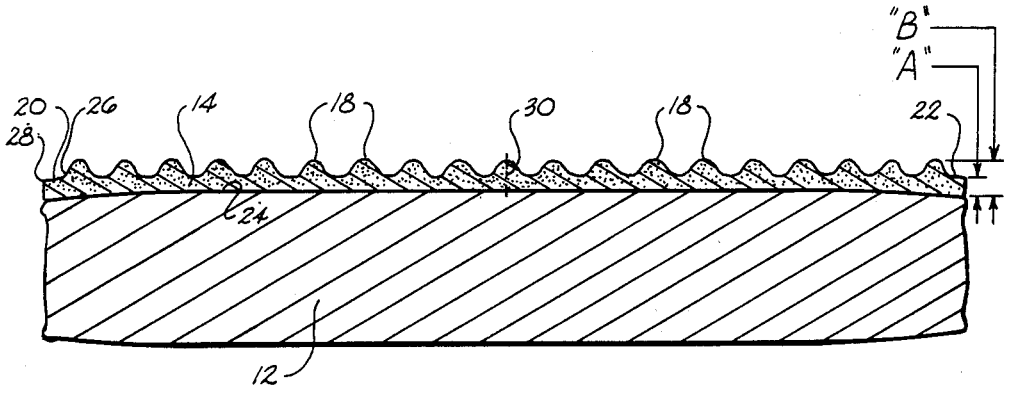
FIG. 2 illustrates a cross-section of the FIG. 1 illustration, as indicated therein.

Referring to FIG. 2, a cross-section of FIG. 1 as indicated therein is illustrated. Mattress pad 14 rests atop conventional mattress 12. Since the rectangular dimensions of mattress pad 14 are specifically in accordance with the associated mattress 12 in this instance, the width of pad 14 is shown as the same as mattress 12. A plurality of projections 18 are illustrated as basically sinusoidal curves formed regularly in a pattern on an upper side of mattress pad 14. Side 24 of mattress pad 14 which rests on the upper surface of mattress 12 is a relatively smooth surface. Thickness "B" illustrated in FIG. 2 represents the distance between the smooth surface 24 and an imaginary surface parallel thereto defined by the peaks of projections 18. This thickness is approximately two inches, as discussed above.

As further illustrated in FIG. 2, planar ledge or marginal region 20 (on the left hand side of FIG. 2) and planar ledge or marginal region 22 (on the right hand side of FIG. 2) are generally flat surfaces, devoid of any projections. The precise width of such regions (eg., the distance between points 26 and 28 of FIG. 2) is preferably about one inch, but may be varied in accordance with this invention. The surface defined by the surfaces of either of marginal regions 20 and 22 may be described as a margin surface which is parallel to the imaginary surface defined by the peaks of projections 18, and also parallel with the flat surface 24 which forms the bottom of mattress pad 14. Width "A" of FIG. 2 illustrates the distance between such a margin surface and the flat bottom surface 24 of FIG. 2. Width "A" is preferably about one inch, but is usually about one half of width "B" , whatever width "B" is selected to be in a given embodiment of the present invention.

Dotted line 30 of FIG. 2 illustrates one possible dividing line of mattress pad 14, as discussed above. For example, if mattress 12 is a king-sized mattress, for convenience in both manufacturing and marketing, mattress 14 may actually comprise two sections intended for edge-to-edge placement during use, as indicated by dotted line 30.

Figure 3:
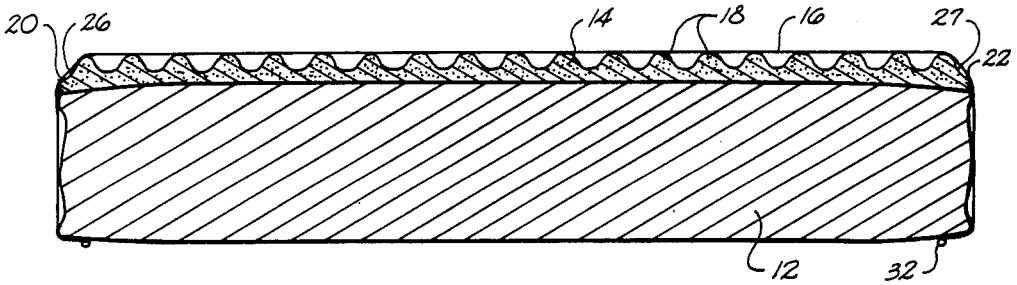
FIG. 3 illustrates another cross-section of FIG. 1, in the plane thereof specifically indicated.

FIG. 3 illustrates another cross-section of FIG. 1, along the indicated plane thereof which differs from the FIG. 2 cross-section. Conventional mattress 12 is covered first with a mattress pad 14 in accordance with this invention, and then with a conventional sheet, such as fitted sheet 16. Fitted sheet 16 has elastic members 32 for a secure fit around mattress 12. The plurality of projections 18 typically are only slightly depressed by the addition of sheet 16. In contrast, marginal regions 20 and 22 resiliently receive the portions of sheet 16 which wrap around the uppermost edges of mattress 12. In doing so, marginal regions 20 and 22 flex to form an angled surface generally downward from points 26 and 27, respectively, so as to accommodate sheet 16 in a manner which lessens the upward force thereon by projections 18 at the farmost edges of mattress pad 14. By resiliently receiving sheet 16 in such a fashion, the thickness "B" of mattress pad 14 may be maximized for increased user comfort, while minimizing the upward thrust effect on sheet 16 at those particular portions thereof which would cause elastic members 32 to be drawn off of the bottom edge of mattress 12.

Figure 3A:
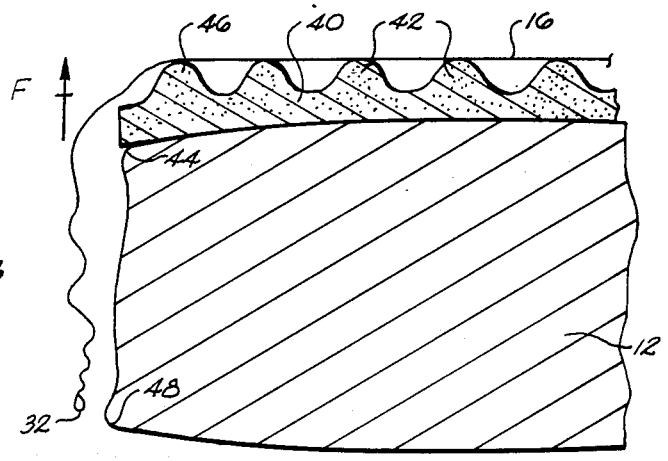
Fig. 3a (PRIOR ART)
FIGS. 3*a* and 3*b* illustrate enlarged partial cross-sections of prior art and the present invention, respectively, both of which illustrate a mattress, mattress pad and sheet.

FIG. 3*a* illustrates an enlarged view of the left hand section of a conventional mattress 12 in use with a typical prior art mattress pad 40. For purposes of direct contrast with the present invention, prior art mattress pad 40 is illustrated as having a plurality of projections 42 which are similar to projections 18 of the present invention. Likewise, conventional sheet 16 is also applied to mattress pad 40 and mattress 12, as in FIG. 3.

In contrast however, prior art mattress pad 40 does not have any flat marginal regions 20 and 22 (i.e., "flat" whenever no sheet is applied) as illustrated in FIG. 2. Consequently, the upward force F applied in FIG. 3*a* near the uppermost left hand corner 44 of mattress 12 is much greater due to projection 46 than the upward force F′ of FIG. 3*b* on sheet 16 at the analogous portion of the present invention. This greater force F of the prior art tends to push upward on sheet 16 to a degree sufficient to cause elastic member 32 of sheet 16 to be pulled from around the lower edge 48 of mattress 12. Whenever such a pull-off event occurs, sheet 16 may be less snug across mattress 12 and mattress pad 40, and thereby provide physical and psychological discomfiture to the user, which virtually defeats the purpose of a supplemental mattress pad.

Figure 3B:
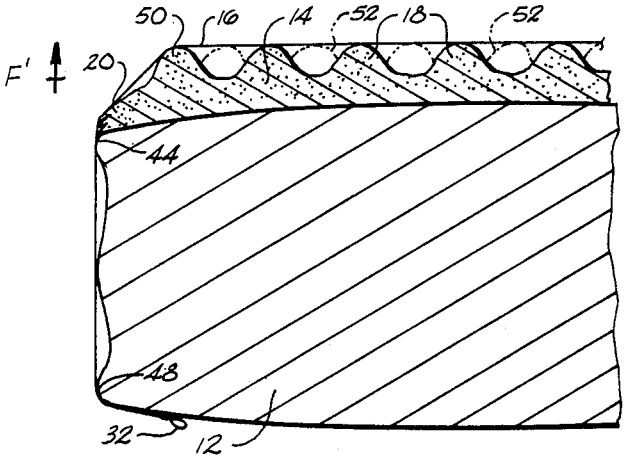

In contrast, as illustrated in FIG. 3*b* of this application, the present invention provides a mattress pad 14 having at least one marginal region, such as marginal region 20, which resiliently receives a conventional sheet 16 onto a conventional mattress 12 so that elastic member 32 of sheet 16 is not pulled from around edge 48 of mattress 12. A much smaller upward force F′ at corner 44 of mattress 12 is illustrated than the upward force F of prior art FIG. 3*a*. The smaller force results from the compression function of the marginal region 20 in response to the presence of sheet 16. Furthermore, the projection (or row of projections) 50 which are closest to marginal region 20 remain relatively unaffected by the presence of sheet 16.

By contrast to the prior art, with reference to FIG. 3*a*, if sheet 16 were pulled sufficiently tight for elastic member 32 thereof to gather around corner 48 of mattress 12, the projection 46 of mattress pad 40 would be detrimentally forced inward instead of undisturbed, as with the present invention. Moreover, the force F would generally increase the more that projection 46 was pushed down by sheet 16.

FIG. 3*b* illustrates further projections 52 in dotted line. These dotted line projections are intended to represent an alternative arrangement of the projections 18 on the upper surface of pad 14, wherein alternating rows of sinusoidal surface projections 18 are staggered so that the peaks of one row of projections (such as 18) are matched with the hills of an adjacent row of projections (such as projections 52). As a further alternative, though not shown, shapes other than sinusoidal may be used. These may include pyramid shapes, square or rectangular shapes, circular shapes, or any other geometrical or nongeometrical shapes, all of which may be truncated or not.

Such modifications to the illustrated figures and any other modifications which would occur to one of ordinary skill in the art are intended to be included within the scope of the present invention. Variations of embodiments based on selections and mixtures of the various different features illustrated and disclosed also form part of this invention. Furthermore, all such modifications and variations are also intended to be included within the meaning of the following claims, which further define and describe this invention.

What is claimed is:

1. A polymeric supplemental support cushion for use between a mattress and a sheet for the mattress, comprising:

a base having a first predetermined thickness, said base being of resilient material, a bottom surface of said base being flat for placement on a mattress, an upper support surface integral with said base and extending a predetermined distance thereabove, said upper support surface including a plurality of rows of sinusoidal curved resilient projections covering substantially the entire upper surface of said support cushion, a planar ledge provided on opposite longitudinal sides of said support cushion, each of said planar ledges extending from a respective outer periphery of said support cushion and terminating at the base of an outer row of said sinusoidal curved projections, said ledges being located about half-way between said bottom surface of said base and the peaks of said sinusoidal curved projection, so that when a sheet is placed on said support cushion, it extends from the peaks of said sinusoidal projections of said outer rows of said projections over said planar ledges then down along the side of said mattress whereby upward forces adjacent the edges of said support cushion are minimized enabling said sheet to be properly retained on said mattress.

2. The cushion as set forth in claim 1 wherein said planar ledges have a width of about one inch.

3. A supplemental support apparatus for addition to the upperside of a mattress, and adapted for subsequent fitting of a sheet thereon, said apparatus comprising:

a resilient pad;

a plurality of support projections, integral with said pad and covering most of the surface thereof; and sheet securement means, located marginally on said surface of said pad, having a width of at least about one inch, and having a thickness generally about onehalf that of said pad and said support projections combined, for reducing upward pressure otherwise caused by said support projections on a sheet fitted on said mattress, whereby overall thickness for said supplemental support apparatus may be maximized while said sheet is still secured to said mattress.

* * * * *